US005402616A

United States Patent [19]

Klein

[11] Patent Number: 5,402,616

[45] Date of Patent: Apr. 4, 1995

[54] CONCRETE WELDMENT AND METHOD OF MANUFACTURE

[75] Inventor: David M. Klein, Burlington, Wis.

[73] Assignee: JW Peters & Sons, Inc., Burlington, Wis.

[21] Appl. No.: 997,019

[22] Filed: Dec. 28, 1992

[51] Int. Cl.[6] ..... G04B 5/10

[52] U.S. Cl. ..... 52/601; 52/578

[58] Field of Search ..... 52/583, 582, 578, 601, 52/715, 699, 583.1, 582.1, 582.2; 249/91, 96, 97

[56] References Cited

U.S. PATENT DOCUMENTS

| | | | |
|---|---|---|---|
| 1,199,077 | 9/1916 | James | 52/699 |
| 1,280,485 | 10/1918 | Kahn | 52/699 |
| 1,334,101 | 3/1920 | Kealy | 52/582 |
| 3,683,578 | 8/1972 | Zimmerman | 52/583 |
| 3,741,701 | 6/1973 | Nelson | 249/91 |
| 3,958,954 | 5/1976 | Ehlenbeck | 52/583 |
| 3,985,482 | 10/1976 | Suzuki | 249/97 |
| 4,724,649 | 2/1988 | Lowndes, III | 52/583 |
| 4,884,958 | 12/1989 | Lowndes, III et al. | 425/62 |
| 4,930,677 | 6/1990 | Jolliffee | 52/583 |

FOREIGN PATENT DOCUMENTS

| | | | |
|---|---|---|---|
| 82202 | 6/1894 | Germany | 52/583 |

*Primary Examiner*—Peter M. Cuomo
*Assistant Examiner*—Darnell M. Boucher
*Attorney, Agent, or Firm*—Knechtel, Demeur & Samlan

[57] ABSTRACT

A metal weldment and method of manufacturing the same in which the metal weldment is embedded in a concrete slab-type structural member. The weldment has a central plate having a planar, weldable surface along an edge of the concrete slab, the weldable surface is perpendicularly disposed to the horizontal plane of the concrete slab. There are a pair of outstanding arms extending from the weldable surface and which are embedded in the concrete slab. The outstanding arms have a constant height across their length and support a steel reinforcing mesh at a predetermined height during the concrete slab casting operation. A blockout is provided to the mold during the casting operation to keep the top edge and front surface of the weldable surface free and clear of concrete. This provides for thermal expansion of the weldable surface and minimizes cracking and spalling of the concrete during welding. The blockout is removed from the mold after the concrete has hardened and can be re-used.

5 Claims, 1 Drawing Sheet

CONCRETE WELDMENT AND METHOD OF MANUFACTURE

FIELD OF THE INVENTION

This invention relates to a metal weldable piece which is embedded in a concrete slab type structure. The weldment is used in joining adjacent concrete structures by welding together the weldments embedded in each of the concrete structures.

BACKGROUND AND SUMMARY OF THE INVENTION

Precast concrete members have become commonly used in the construction of walls and decks. These members are manufactured in a facility and then shipped to the job location and erected. The typical prefabricated concrete members used in parking lots to form the deck are in the form of beams. The horizontal portion of the beam is a slab which is the load bearing surface and generally contains reinforcing mesh or pre-stressed strands. To form the deck, the concrete members are positioned adjacent to each other so that the edges of the slabs are abutting.

When using concrete beams to form a deck or wall, it is possible for the members to move relative to each other. This is the result of wind forces or thermal expansion. In order to prevent or minimize the relative movement and to further increase the strength of the structure, metal inserts called "weldments" are placed in the edges of the slab. When the concrete slabs are positioned for final assembly, the metal pieces of one slab are aligned with and opposite to a complementary metal piece in the adjacent slab. The metal pieces are welded together to provide a unitary structure which is much stronger than had the slabs not been joined.

One type of weldment which was commonly used in the past was a "U" shaped cylindrical reinforcing bar. Such bars were commonly used in the precast concrete slabs. The reinforcing bars were bent in a generally "U" shaped configuration with the arms embedded in the concrete and the base portion of the "U" shaped configuration exposed along the edge of the concrete slab. This exposed portion was the portion which was welded to a reinforcing bar embedded in an adjacent concrete slab. A problem with this type of weldment is that the parallel arms of the "U" shaped bar cannot be precisely positioned within the concrete slab as it is formed. Once the concrete is poured into the mold, it is impossible to determine the location of the "U" shaped parallel portions of the bar within the slab. Due to this, the reinforcing bar weldments are often not properly positioned within the slab and will pull out of the slab under load.

An improvement of the reinforcing bar weldment is illustrated in U.S. Pat. No. 3,958,954 entitled Concrete Weldment. The problem with the weldment illustrated in the '954 patent is that the tails 26 which are embedded in the concrete are disposed at an angle with respect to the vertical axis. In order for the reinforcing mesh to rest upon these tails, the tails must either be turned at a downward angle into the concrete or be placed further down into the slab to allow the mesh to be buried at least one and one half inches below the top surface of the concrete slab. Ideally, the reinforcing mesh should come within one inch of the edge of the slab. Thus, the design illustrated in the '954 patent does not permit the mesh to come within one inch of the edge and still be buried one and a half inches below the top surface of the concrete without giving rise to the problems as discussed above. If the tails are angled downward, there is a great possibility that the tails could come very close to, if not protrude through the bottom of the slab. Another problem in the '954 embodiment is that the method of manufacturing the slab does not provide that the central portion 22 of the weldment 20 will remain free of concrete during manufacture. This either decreases the weldable surface or results in concrete cracks and spalling from the welding operation.

Accordingly, it is an object of the present invention to provide a new and improved concrete weldment which is inserted and cast into the edge of a concrete slab. It is a further object to provide a weldment which reduces the possibility of concrete cracks and spalling from the welding operation.

It is another object to provide a weldment which will support a reinforcing mesh within the concrete mold during the molding operation. Related to this object is the object of providing a weldment which will accurately position the mesh within the mold and retain it in this position such that the resulting slab has the mesh buried in the slab at a proper depth and within a predetermined distance from the edge of the slab.

It is yet another object to provide a weldment having arms which extend into the concrete slab to secure the weldment into the slab, yet, not have the arms protrude through the bottom of the slab.

Another object is the object of providing a weldment which has a weldable portion which is free from concrete both in the welding area and along its top edge. The advantage of this design is that it increases the weldable area and allows for thermal expansion of the weldment without cracking and spalling of the concrete.

Yet, another object is the object of providing a method of manufacturing concrete slabs such that the weldment is cast into the slab yet concrete is restricted from flowing over the front of the weldable surface of the weldment or over the top edge of the front portion of the weldment. A related object is to provide a mold blockout which protects the weldment during the formation of the concrete slab yet is removable and reusable in the manufacture of subsequent concrete slabs.

Applicant's invention solves the problems set forth above. Applicant provides a weldment which is embedded into the concrete slab structure in the fabrication process. The weldment has a central plate which forms the weldable surface of the weldment. It is perpendicularly positioned with respect to the horizontal plane of the concrete slab. This is accomplished by accurately positioning the weldment with respect to the mold cavity. The planar surface of the central plate is positioned along an edge of the concrete slab. There are a pair of outstanding arms extending divergingly outward from each of the ends of the central plate. The outstanding arms remain at a constant height across their length with the height of the arms being selected to support the reinforcing mesh at a predetermined depth within the concrete slab. The weldment is accurately positioned within the mold by means of a positioning screw which passes through a portion of the mold and into the weldment. Thus, the weldment is accurately positioned each and every time within the mold before the concrete is poured. A blockout is placed on top of the top edge of the central plate of the weldment during the manufacturing process. The blockout keeps the concrete from being poured onto the top edge of the central plate and also keeps the outer face of the central plate clear of concrete. After the concrete slab is formed, the blockout is removed leaving the top edge and front surface of the central plate clean. This results in an outer face with an increase in the weldable area and, furthermore, allows for thermal expansion of the weldment without cracking and spalling of the concrete.

DESCRIPTION OF THE PREFERRED EMBODIMENT

Figure 1:
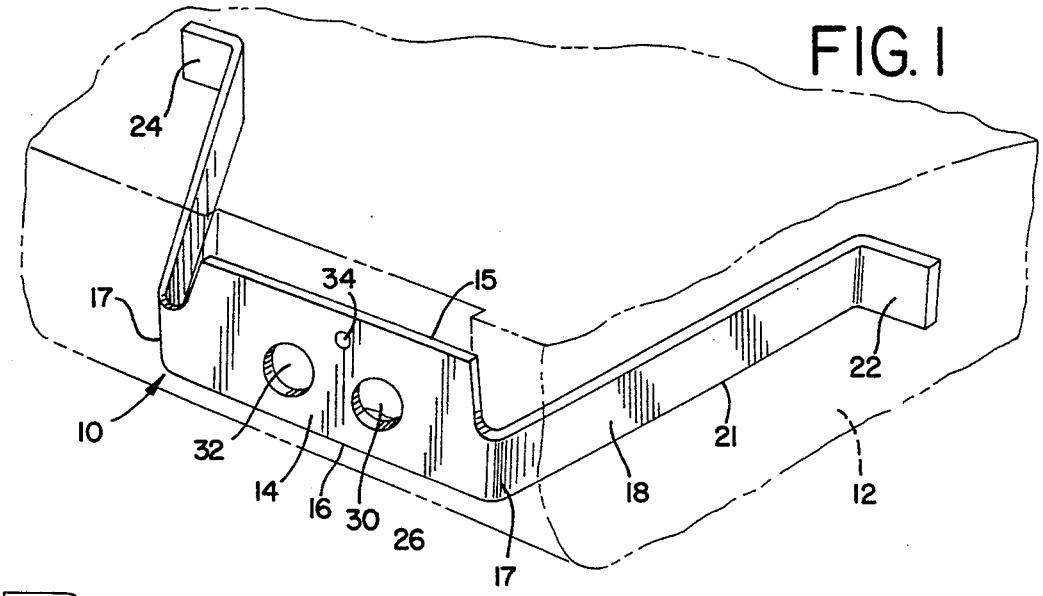
FIG. 1 is a perspective view of the inventive weldment embedded in a concrete structural member which is shown in phantom.

Turning first to FIG. 1, there is illustrated a weldment 10 of the present invention. It is designed to be embedded into a concrete structural member or slab 12. The concrete slabs 12 are generally designed having an extended length as compared to its width. They are generally positioned so that the long edges of the slabs are abutting to each other to form a building element such as a wall or deck surface. The weldments 10 are placed at predetermined distances along the long edge of the slab 12. When the slabs are placed adjacent to each other, the weldments 10 should be in close proximity to each other such that they can be welded together to increase the strength of the overall wall or deck surface.

Figure 3:
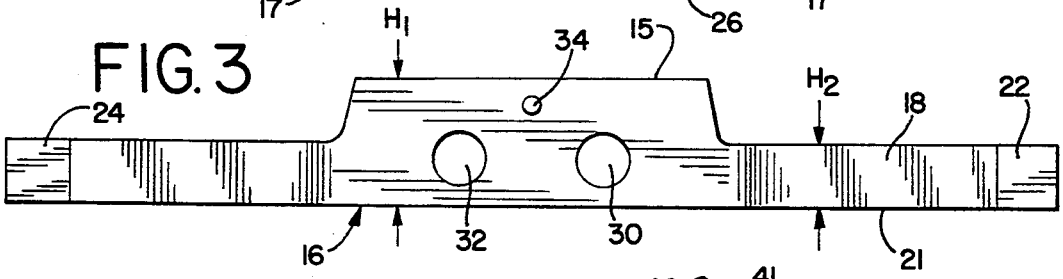
FIG. 3 is a front elevational view of the weldment of the present invention.

The weldment 10 has a central plate 14. There is a top edge 15 which, according to the present design, is to be open and not embedded in the concrete slab 12. Opposite the top edge 15 is a bottom edge 16, the top and bottom edges 15 and 16, defining the height, $H^1$, of the central plate 14 (FIG. 3). The central plate 14 has opposite ends 17 from which extend diverging arms 18, 20. The height $H^2$, (FIG. 3) of the arms 18, 20 is substantially constant across their entire length. The arms 18, 20 have a bottom edge 21 which is in the same plane as the bottom edge 16. Out-turned flanges 22, 24 are connected to the ends of the arms 18, 20 opposite the ends 17. The plane of the flanges 22, 24 are parallel to the plane of the central plate 14.

Figure 2:
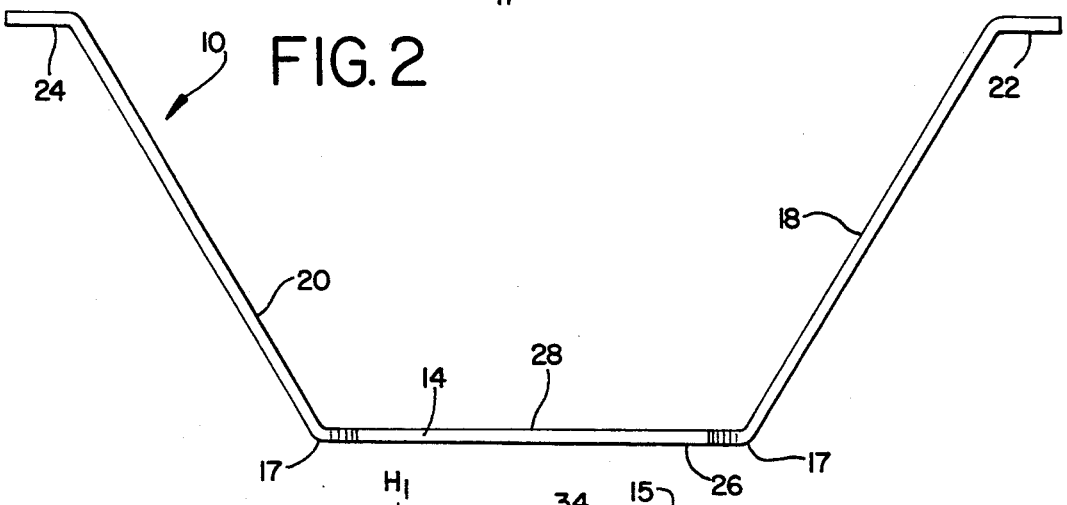
FIG. 2 is a top plan view of the weldment of the present invention.

Turning to FIG. 2, it can be seen that the central plate has an outer face 26 and an inner face 28. The outer face 26 presents a weldable surface. The inner face 28 is in contact with the concrete of the concrete slab 12. The bottom edge 16 is at least partially embedded into the concrete slab 12.

In FIG. 3, it can be seen that there are a pair of openings 30, 32 in the central plate 14. When the concrete slab 12 is formed, a portion of the concrete flows into these openings and hardens further anchoring the weldment 10 into the concrete slab 12. There is also a screw receiving hole 34 at the top portion of the central plate 14. The purpose of the hole 34 is to receive a self-tapping screw 48 (see FIG. 4) which accurately positions and holds the weldment 10 during the concrete slab manufacturing process.

Figure 4:
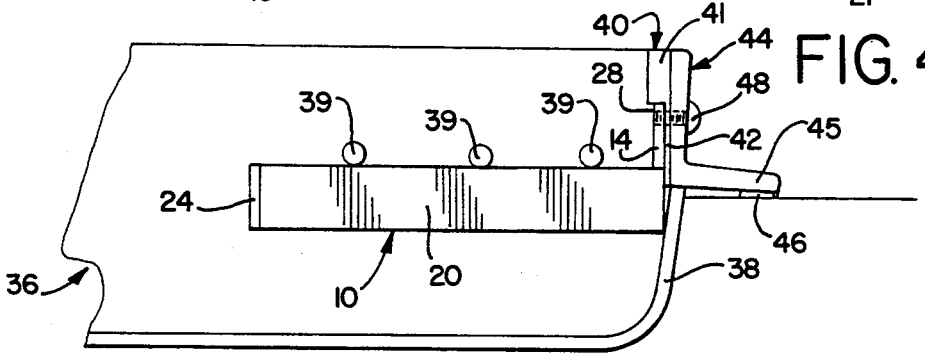
FIG. 4 is a side view with portions removed of the weldment positioned in the mold used to form the concrete slab.

Turning to FIG. 4, there is illustrated a mold 36 which is used to make the concrete slab 12. The mold has a bottom form 38 which defines the edges and outer dimensions of the length and width of the concrete slab 12. During manufacturing, the weldment 10 is placed into the mold 38 as seen in FIG. 4. Reinforcing wire mesh 39 is placed on top of the arms 18, 20. The arms 18, 20 will support the wire mesh 19 during the concrete slab manufacturing process. Ideally, the reinforcing wire mesh will be placed at least one and a half inches below the top surface of the concrete slab and within one inch of the inner face 28 of the central plate 14.

Before the concrete slab is cast, a blockout 40, which is an added molding piece, is placed on top of the top edge 15 of the central plate 14. The blockout 40 has a top portion 41 which rests upon the top edge 15 of the central plate 14. The blockout 40 is configured in an inverted "L". There is a longer leg 42 which is substantially thinner than the top portion 41. The leg 42 extends down below the top edge 15 and covers the outer face 26 of the central plate 14.

A frame support 44, which is also in an "L" shaped configuration, is pushed up against the blockout 40. The self-tapping screw 48 passes through the frame support 44, through the leg 42 and into the screw receiving hole 34 in the central plate 14. The screw 48 is tightened and holds the weldment 10 at the proper height within the mold 36. The bottom of the frame support 44 has an outstanding leg 45 which rests upon a spacing support 46. This aids in securely holding the frame support 44, blockout 40, and weldment 10 in its proper orientation and location during the concrete slab casting operation.

With all the elements securely positioned as illustrated in FIG. 4, concrete is poured into the mold 36 until it reaches the proper height within the mold. The concrete is allowed to harden and the mold is then removed. The screw 48, the frame support 44, and blockout 40 are all removed from the formed concrete slab 12. The blockout 40 keeps concrete from being poured on top of the top edge 15 or outer face 26 during the slab forming operation. The blockout 40 can be re-used when subsequent slabs are cast. The reinforcing wire mesh 39 was supported by the arms 18, 20 and is buried within the slab at the proper depth.

By adjusting the spacer 46 and the frame support 44, the position of the weldment 10 within the mold 36 can be varied. However, the arms 18, 20 of the weldment 10 remain parallel to the top and bottom surfaces of the finished concrete slab 12. Thus, the arms 18, 20 will always be positioned at the proper depth within the concrete slab 12 throughout the entire length of the arms 18, 20. Also, as the top edge 15 of the central plate 14 is free of concrete, it allows for thermal expansion of the central plate 14 during the welding operation without the fear of cracking and spalling of the concrete. Also, as the outer face 26 is free of concrete, it represents a larger weldable area and makes it easier to weld the adjacent concrete slabs to each other by presenting a larger weldable face.

Thus, it is apparent that there has been provided, in accordance with the invention, an improved concrete weldment and method of manufacturing the same that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A metal weldment embedded in a concrete slab-type structural member for joining together adjacent structural members, the weldment comprising:

a central plate of a first height and having a top edge, opposite ends and a planar, weldable front surface perpendicularly disposed to the horizontal plane of the concrete slab-type structural member, the planar surface further disposed along an edge of the concrete slab;

a pair of outstanding arms, each arm extending divergingly out from one of the ends of the central plate, the outstanding arms having a constant height across their length, the height of the arms being less than the height of the central plate, the arms supporting a mesh structure at a uniform predetermined height within the concrete slab, the height of the arms being selected to support the mesh at the predetermined height, end flanges extending out from each of the ends of the arms in a plane substantially parallel to the plane of the central plate for further securing the weldment inside the concrete slab, the end flanges being of the same height as the outstanding arms, at least one opening in the central plate which fills with concrete during the casting of the slab and which assists in securing the weldment of the slab after the concrete has hardened, and a reusable blockout for protecting the top edge and front surface of the central plate from concrete being poured over it during the casting of the concrete slab, the top edge on the central plate supporting the blockout as the concrete is poured over the weldment during the casting of the concrete slab.

2. The weldment of claim 1 wherein the plane of the central plate and plane of the arms are both substantially vertical with respect to the horizontal plane of the concrete slab and the bottom edge of the central plate is in the same plane as the bottom edge of the arms.

3. The metal weldment of claim 1 wherein the arms extend out from the central portion at an angle of between 50° and 70° as measured from a line perpendicular to the plane of the central portion.

4. The weldment of claim 1 and further comprising a positioning hole disposed in the face of the central plate, locating and positioning means disposed within the slab, the positioning hole receiving the locating and positioning means to position the weldment at a predetermined height and location in the slab.

5. The weldment of claim 1 wherein the blockout is removed for re-use after the slab is formed leaving the top edge surface substantially free from concrete.

* * * * *